US010271594B1

(12) United States Patent
Cook

(10) Patent No.: US 10,271,594 B1
(45) Date of Patent: Apr. 30, 2019

(54) HOSPITAL GARMENT

(71) Applicant: Vesta Jo Cook, Adelphi, OH (US)

(72) Inventor: Vesta Jo Cook, Adelphi, OH (US)

( * ) Notice: Subject to any disclaimer, the term of this patent is extended or adjusted under 35 U.S.C. 154(b) by 0 days.

(21) Appl. No.: 15/992,654

(22) Filed: May 30, 2018

Related U.S. Application Data

(60) Provisional application No. 62/554,219, filed on Sep. 5, 2017.

(51) Int. Cl.
*A41D 13/12* (2006.01)

(52) U.S. Cl.
CPC ..... *A41D 13/1245* (2013.01); *A41D 13/129* (2013.01)

(58) Field of Classification Search
CPC ..... A41D 13/1245
USPC ..... 2/114, 69; 128/873, 874, 878
See application file for complete search history.

(56) References Cited

U.S. PATENT DOCUMENTS 5,564,123 A * 10/1996 Grassick ..... A41D 13/1245 2/114
5,611,087 A * 3/1997 Adkins ..... A41D 13/1236 2/114
6,216,271 B1 * 4/2001 Chen ..... A41D 13/1245 2/114
2015/0374048 A1 * 12/2015 Theodossiou ..... A41D 13/1245 2/114
2016/0128391 A1 * 5/2016 Moore ..... A41D 13/1245 2/128

* cited by examiner

*Primary Examiner* — Gloria M Hale
(74) *Attorney, Agent, or Firm* — Matthew M. Googe; Robinson IP Law, PLLC

(57) ABSTRACT

A post-surgical garment includes: a body portion having a neck opening located at a top of the body portion, a waist opening at a bottom of the body portion distal from the neck opening, and opposing first and second sides; a sleeve attached to the first side of the body portion; an armhole opening formed on the second side of the body portion opposite the sleeve, wherein the body portion is split between a bottom of the armhole opening and the bottom of the body portion; and a first closure mechanism located on opposing sides of the split formed on the body portion, the first closure mechanism for securing a front side of the split body portion to a back side of the split body portion to secure the post-surgical garment on a wearer.

11 Claims, 14 Drawing Sheets

HOSPITAL GARMENT

CROSS-REFERENCE TO RELATED APPLICATION

This application claims priority to U.S. Provisional Patent Application Ser. No. 62/554,219 for a "Hospital Garment" filed on Sep. 5, 2017, the contents of which are incorporated herein by reference in its entirety.

FIELD

This disclosure relates to the field of functional clothing. More particularly, this disclosure relates to upper-body garments designed to facilitate both ease of use by post-surgery recovery patients, amputees, and other infirmed individuals and caretaking of said individuals.

BACKGROUND

Patients who undergo surgical procedures on their upper appendages generally are precluded from moving their body in accord with normal ranges of motion, presenting several uncomfortable situations throughout the post-surgical recovery process. Many operations leave an individual without the ability to orient their body in such a manner as to allow for ordinary movement and control, leaving many patients with feelings such as insecurity and irritation as they are increasingly dependent on help from another. One commonly recurring source of frustration experienced by many patients is the lack of ability to dress themselves as normal, due to the inhibited nature of their extremities. Similar situations also arise for patients who have suffered a stroke, have experienced a traumatic injury, have lost an appendage, or are generally infirmed and require considerable assistance in their day-to-day routine.

What is needed, therefore, is an improved garment of clothing that increases ease of use by the individual and caretakers, alike.

SUMMARY

The following summary describes features of the various embodiments of the invention. It is not intended to limit the description of the invention in any way.

The disclosed improvements form an apparatus that satisfies the need for a more suitable article of clothing, as described above.

In a first aspect, a post-surgical garment includes: a body portion having a neck opening located at a top of the body portion, a waist opening at a bottom of the body portion distal from the neck opening, and opposing first and second sides; a sleeve attached to the first side of the body portion; an armhole opening formed on the second side of the body portion opposite the sleeve, wherein the body portion is split between a bottom of the armhole opening and the bottom of the body portion; a first closure mechanism located on opposing sides of the split formed on the body portion, the first closure mechanism for securing a front side of the split body portion to a back side of the split body portion to secure the post-surgical garment on a wearer.

In one embodiment, the first closure mechanism comprising a hook and loop-type fastener. In another embodiment, the first closure mechanism further a first hook strip extending from the back side of the split body portion and a corresponding loop portion attached on the front side of the split body portion for engaging the first hook strip when the post-surgical garment is worn. In yet another embodiment, the garment further includes a bracing patch located on the back side of the split body portion adjacent the first hook strip.

In one embodiment, in a closed position, the first closure mechanism secures a portion of the front side of the split body portion between the first hook strip and a portion of the back side split body portion.

In another embodiment, the post-surgical garment has the appearance of a polo-style shirt. In yet another embodiment, the post-surgical garment has the appearance of a tank top shirt.

In one embodiment, the garment further includes a circular portion attached over the armhole opening to substantially cover the armhole opening of the post-surgical garment.

In a second aspect, a post-surgical garment includes: a body portion having a neck opening located at a top of the body portion, a waist opening at a bottom of the body portion distal from the neck opening, and opposing first and second sides; a sleeve attached to the first side of the body portion; an armhole opening formed on the second side of the body portion opposite the sleeve, wherein the body portion is split between a bottom of the armhole opening and the bottom of the body portion; a first closure mechanism located on opposing sides of the split formed on the body portion, the first closure mechanism for securing a front side of the split body portion to a back side of the split body portion to secure the post-surgical garment on a wearer, the first closure mechanism including a first hook strip extending from the back side of the split body portion and a corresponding loop portion attached on the front side of the split body portion for engaging the first hook strip when the post-surgical garment is worn.

In one embodiment, the garment includes a bracing patch located on the back side of the split body portion adjacent the first hook strip. In another embodiment, in a closed position, the first closure mechanism secures a portion of the front side of the split body portion between the first hook strip and a portion of the back side split body portion.

In a third aspect, a post-surgical garment includes: a body portion having a neck opening located at a top of the body portion, a waist opening at a bottom of the body portion distal from the neck opening, and opposing first and second sides; a sleeve attached to the first side of the body portion; an armhole opening formed on the second side of the body portion opposite the sleeve, wherein the body portion is split between a bottom of the armhole opening and the bottom of the body portion; a first closure mechanism located on opposing sides of the split formed on the body portion, the first closure mechanism for securing a front side of the split body portion to a back side of the split body portion to secure the post-surgical garment on a wearer, the first closure mechanism including a first hook strip extending from the back side of the split body portion and a corresponding loop portion attached on the front side of the split body portion for engaging the first hook strip when the post-surgical garment is worn; a bracing patch located on the back side of the split body portion adjacent the first hook strip. In a closed position, the first closure mechanism secures a portion of the front side of the split body portion between the first hook strip and a portion of the back side split body portion.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Figure 1A:
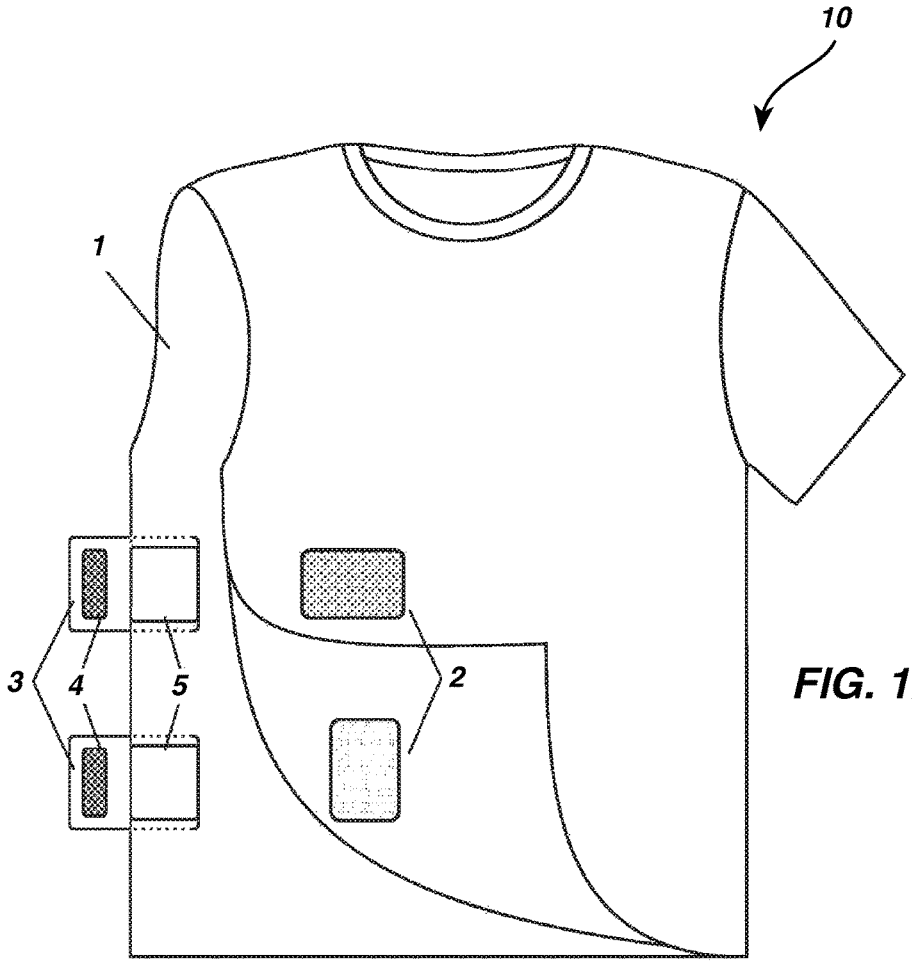
FIGS. 1A-1C show a perspective view of an improved upper-body garment for a patient formed as a short-sleeved shirt according to one embodiment of the present disclosure.
Figure 1B:
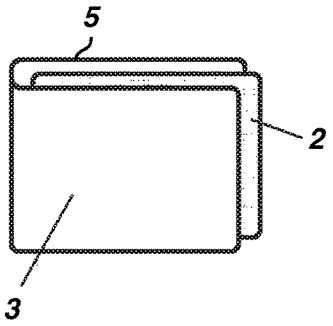
Figure 1C:
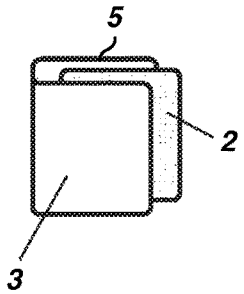
Figure 2A:
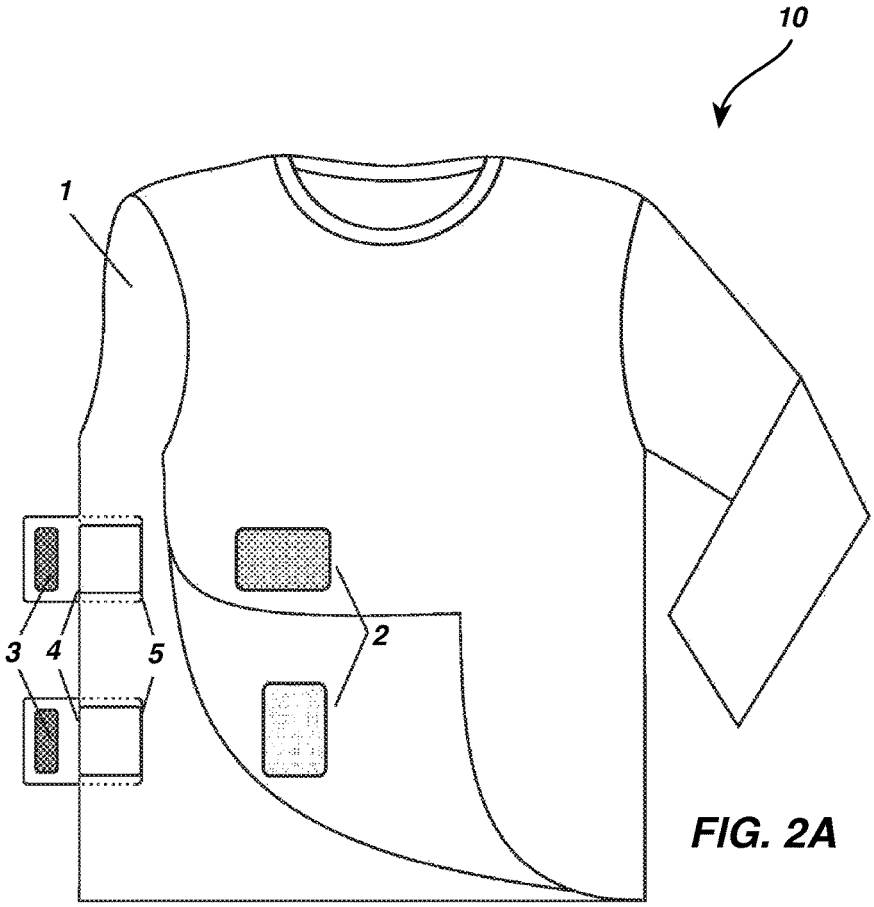
FIGS. 2A-2C show a perspective view of an improved upper-body garment for a patient formed as a long-sleeved shirt according to one embodiment of the present disclosure.
Figure 2B:
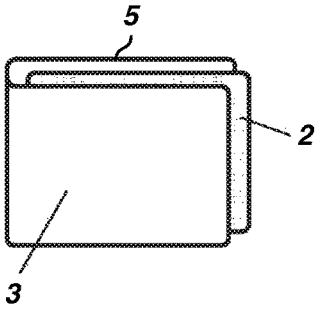
Figure 2C:
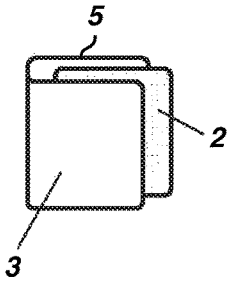
Figure 3A:
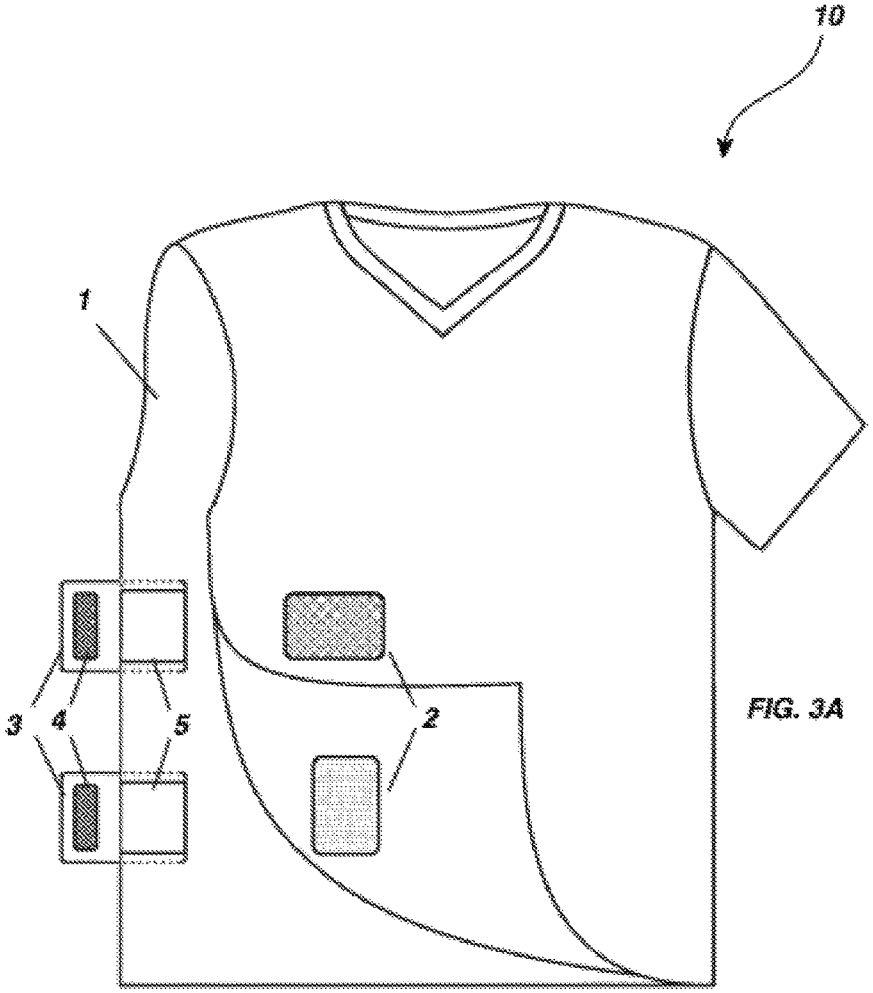
FIGS. 3A-3C show a perspective view of an improved upper-body garment for a patient formed as a short-sleeved v-neck shirt according to one embodiment of the present disclosure.
Figure 3B:
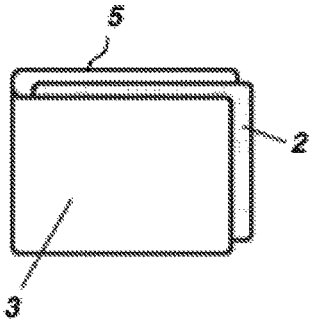
Figure 3C:
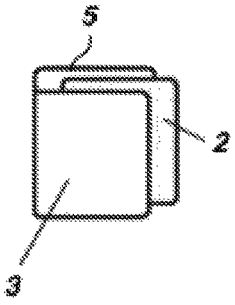
Figure 4A:
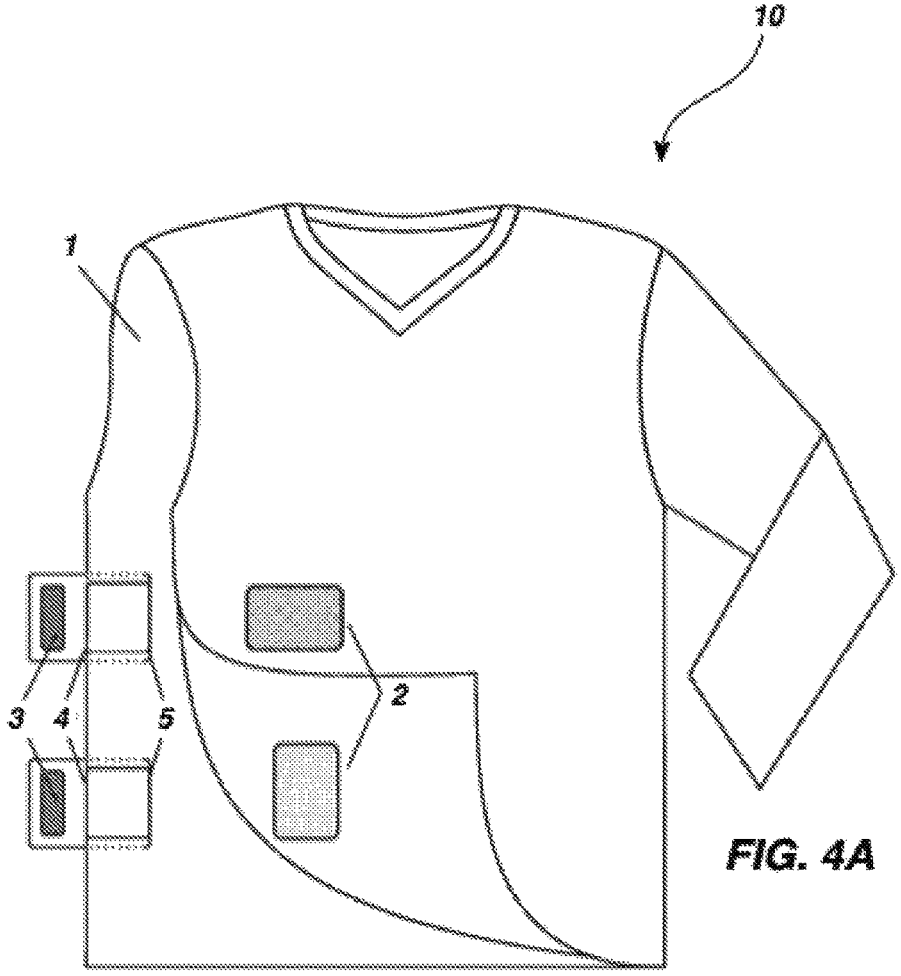
FIGS. 4A-4C show a perspective view of an improved upper-body garment for a patient formed as a long-sleeved v-neck shirt according to one embodiment of the present disclosure.
Figure 4B:
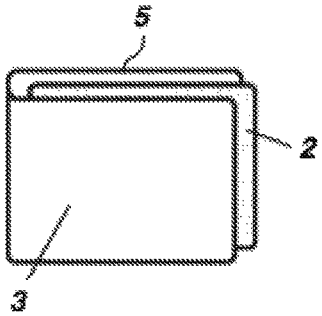
Figure 4C:
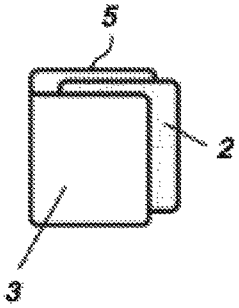
Figure 5A:
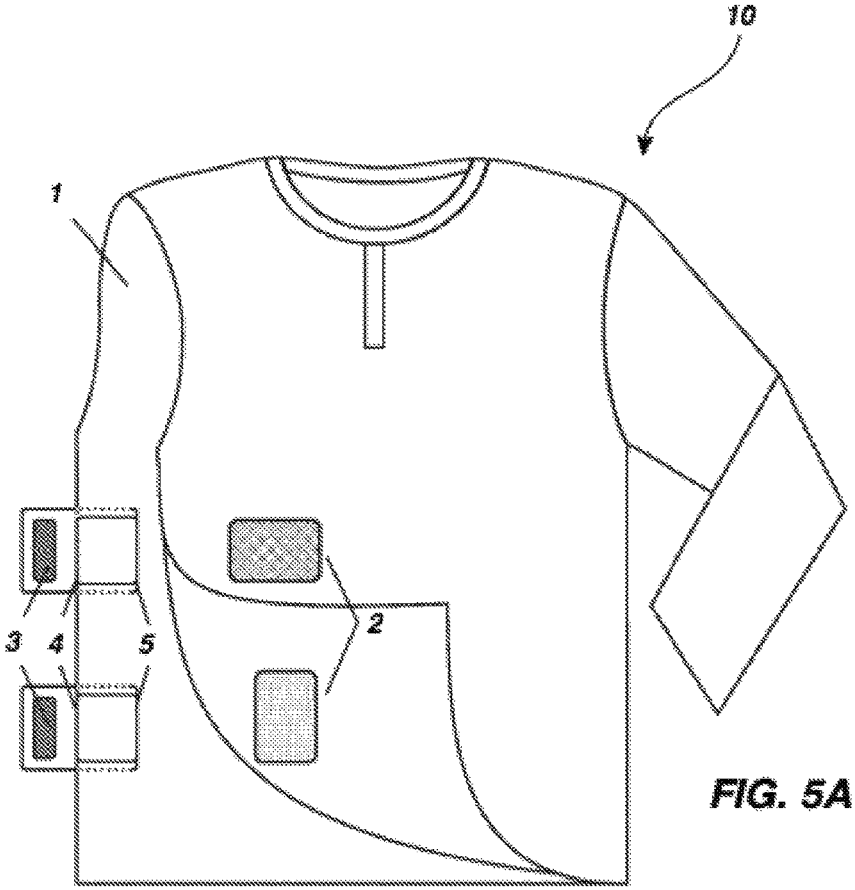
FIGS. 5A-5C show a perspective view of an improved upper-body garment for a patient formed as a long-sleeved Henley shirt according to one embodiment of the present disclosure.
Figure 5B:
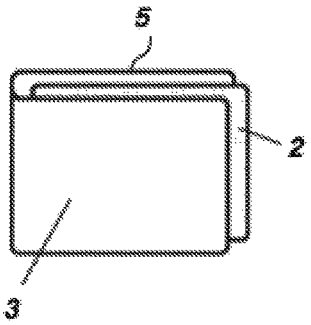
Figure 5C:
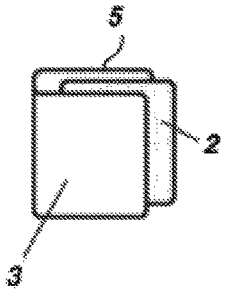
Figures 6A, 6B, 6C:
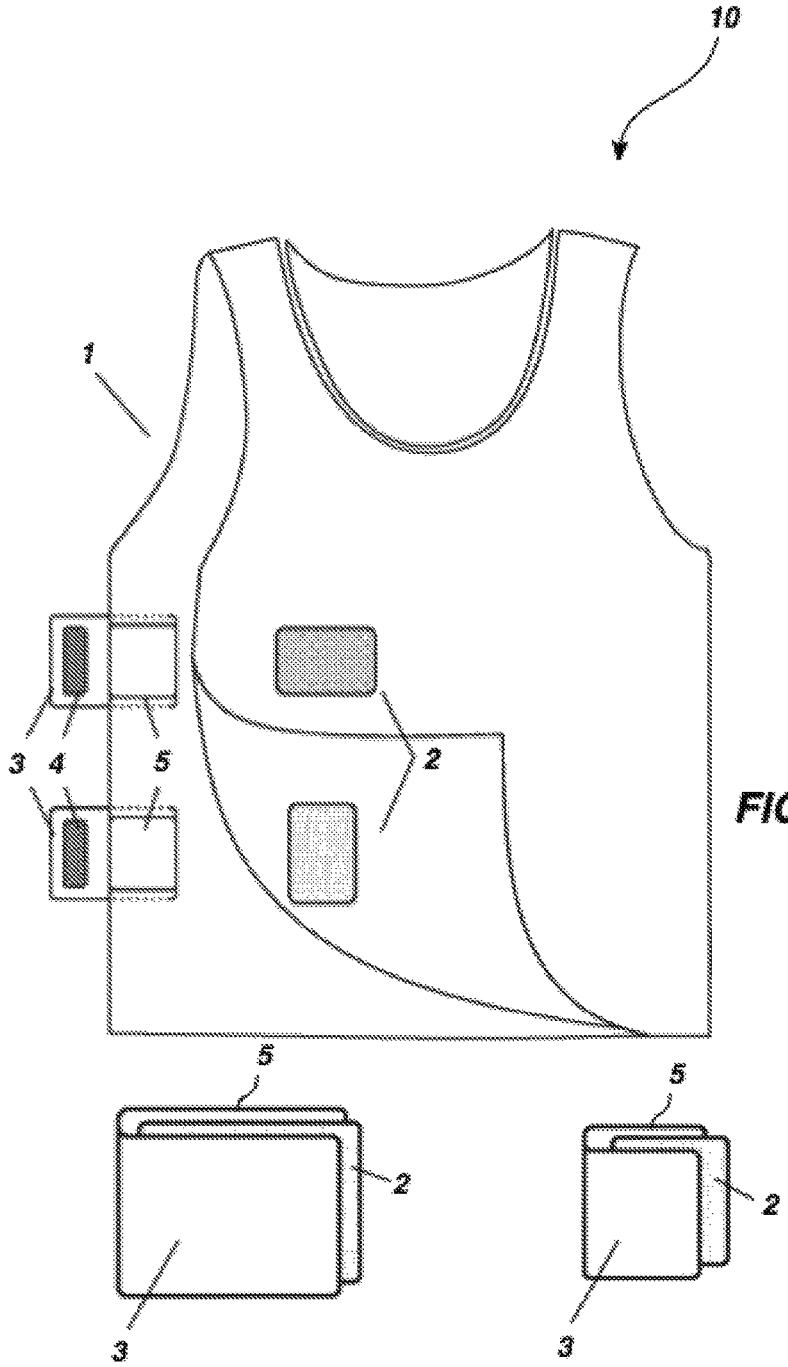
FIGS. 6A-6C show a perspective view of an improved upper-body garment for a patient formed as a tank top shirt according to one embodiment of the present disclosure.
Figure 7A:
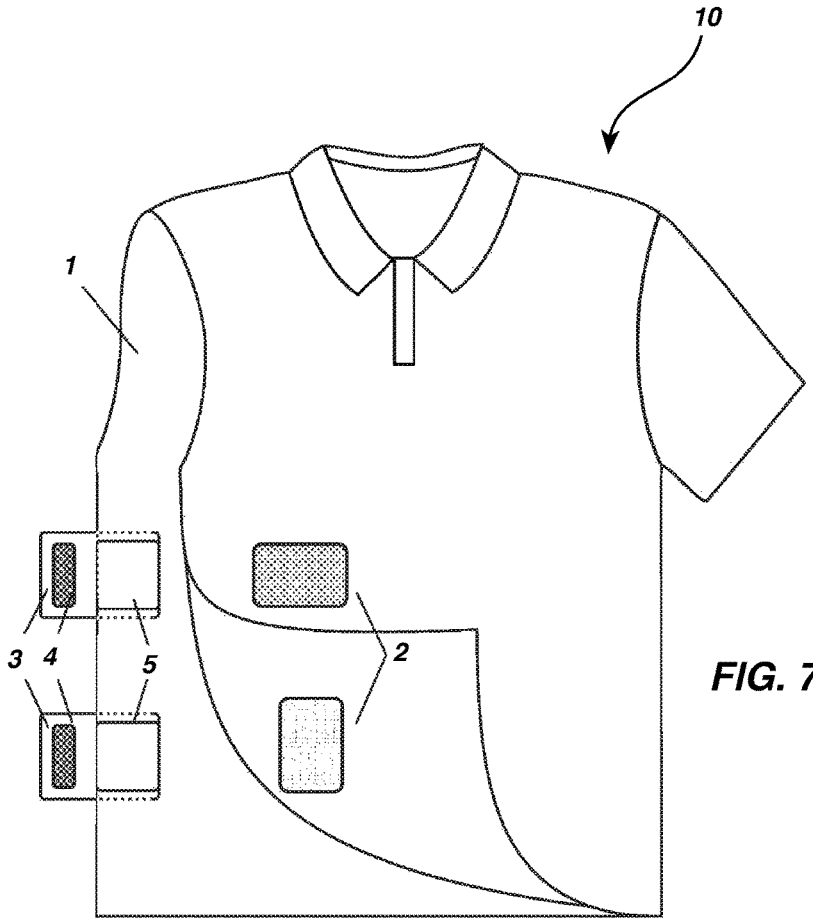
FIGS. 7A-7C show a perspective view of an improved upper-body garment for a patient formed as a polo shirt according to one embodiment of the present disclosure.
Figure 7B:
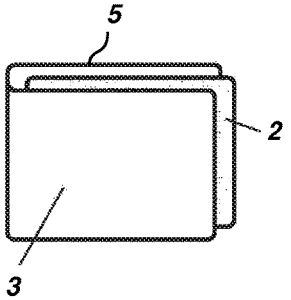
Figure 7C:
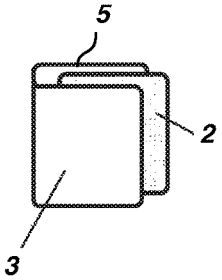
Figure 8A:
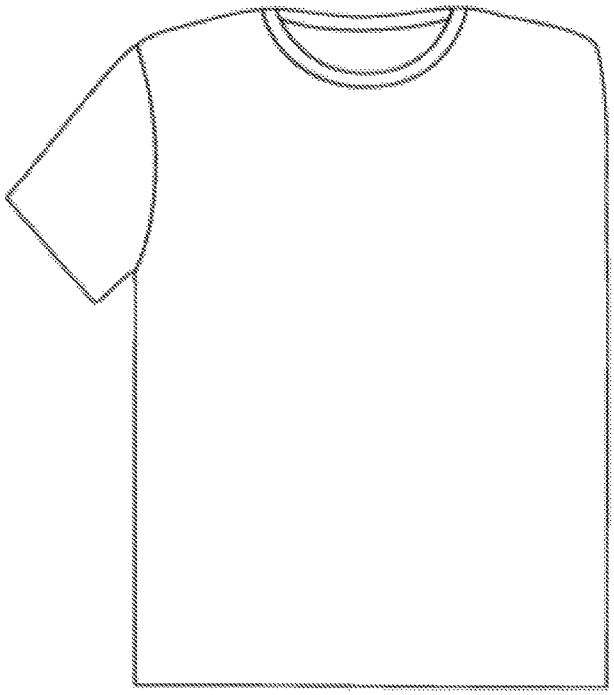
FIGS. 8A and 8B show front and side views of an improved upper-body garment for a patient formed as a short-sleeved shirt according to one embodiment of the present disclosure.
Figure 8B:
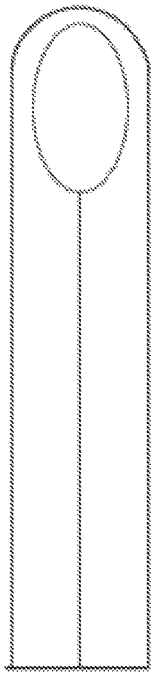
Figure 9A:
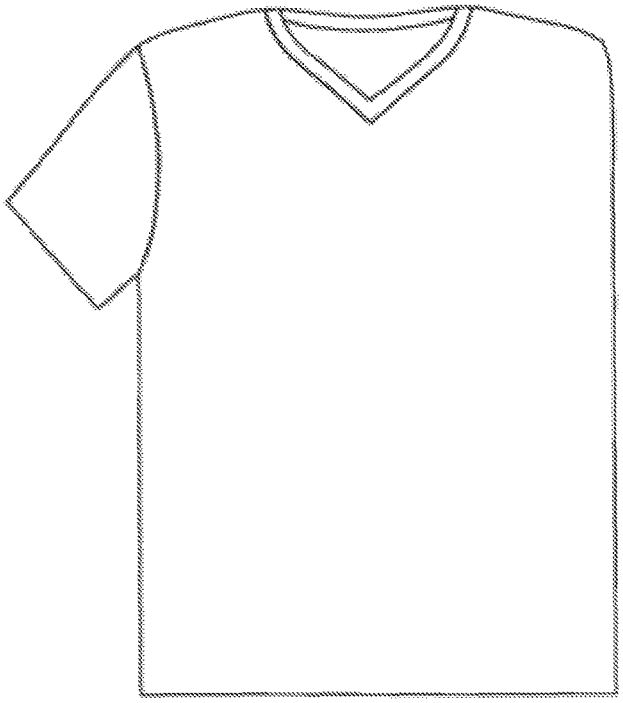
FIGS. 9A and 9B show front and side views of an improved upper-body garment for a patient formed as a long-sleeved shirt according to one embodiment of the present disclosure.
Figure 9B:
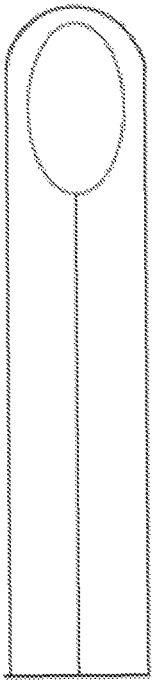
Figure 10A:
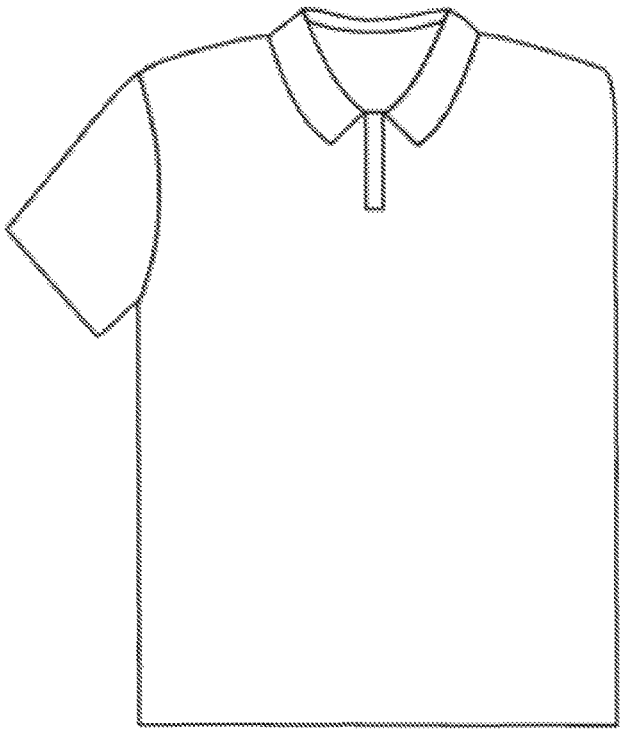
FIGS. 10A and 10B show front and side views of an improved upper-body garment for a patient formed as a polo shirt according to one embodiment of the present disclosure.
Figure 10B:
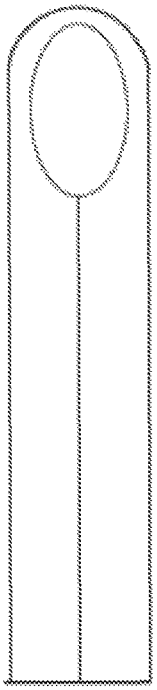
Figure 11A:
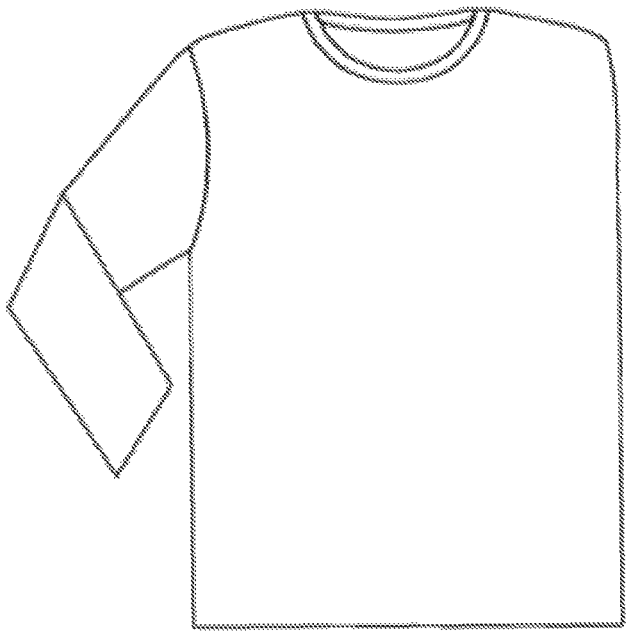
FIGS. 11A and 11B show front and side views of an improved upper-body garment for a patient formed as a long-sleeved shirt according to one embodiment of the present disclosure.
Figure 11B:
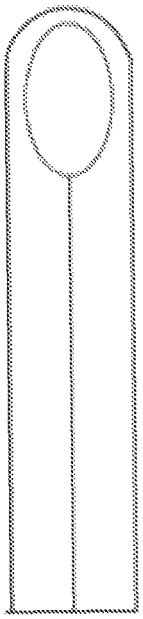
Figure 12A:
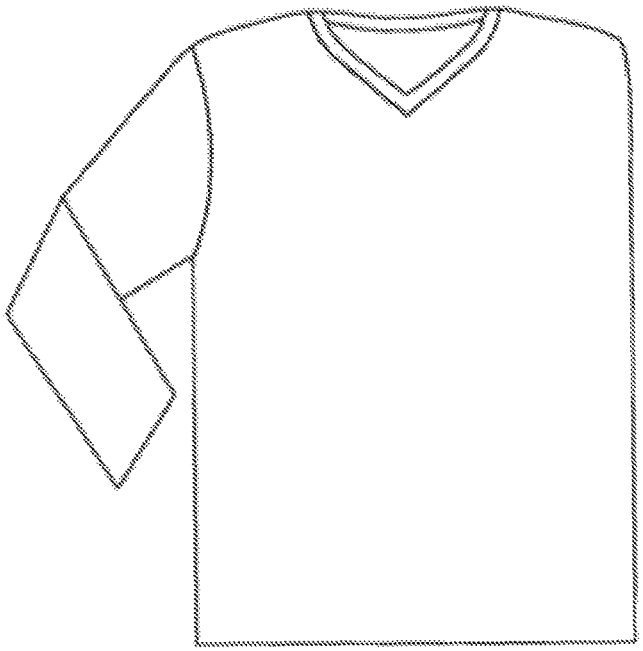
FIGS. 12A and 12 B show front and side views of an improved upper-body garment for a patient formed as a long-sleeved v-neck shirt according to one embodiment of the present disclosure.
Figure 12B:
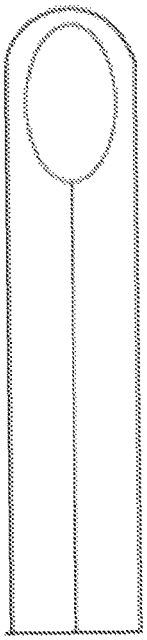
Figure 13A:
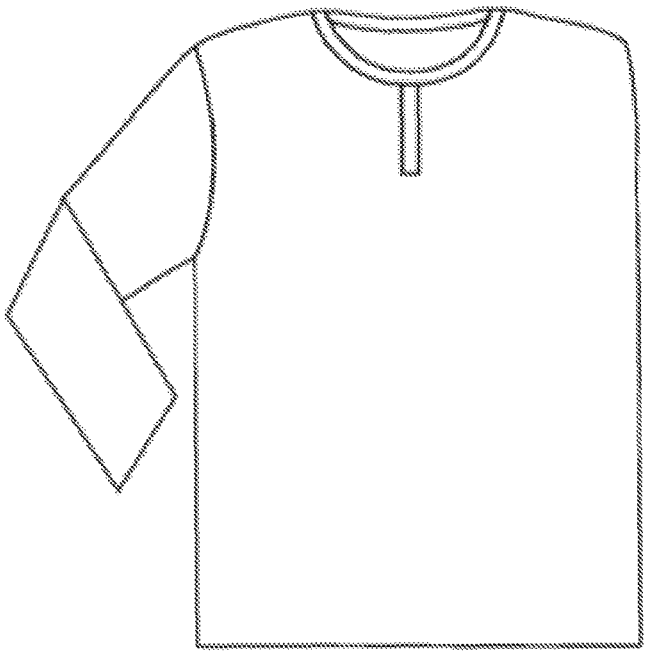
FIGS. 13A and 13B show front and side views of an improved upper-body garment for a patient formed as a long-sleeved Henley shirt according to one embodiment of the present disclosure.
Figure 13B:
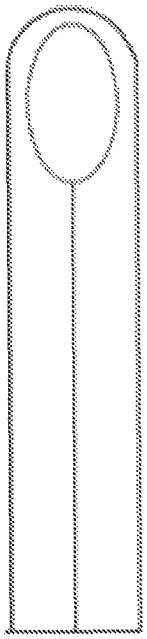

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

As shown in FIGS. 1-14, an improved post-surgical garment 10 allows the user to retain a sense of dignity and feeling of independence throughout the immobile stages of health, and also allows for easy access and provision by others in situations requiring more permanent forms of assistance to the individual.

FIGS. 1-7 show variations on one embodiment of the apparatus wherein the upper-body garment has an interior portion and an exterior portion, is made of durable yet soft textile materials such as cotton and has at least one opening 1 to accommodate the process of dressing and undressing of the wearer such that the clothing may be donned without disrupting the position of the wearer's immobile appendage. A hook and loop-type material such as a Velcro® strip 2 and a hook-type Velcro® strip 4 adhere to the exterior of the garment such that the strips interlock when the article is in the closed position. The strips 2 and 4 may be secured to the fabric of the garment by stitching or adhesive, or any other means commonly understood in the art. The strips 2 and 4 may also be secured via placement of a bracing patch 5 on the correlating internal section of the garment, increasing durational utility of the apparatus by reducing the effect of forces associated with pulling the cloth, wear and tear, etc. In another embodiment, additional bracing patches 5 may align the open edges of the shirt, reinforcing the fabric as it is pulled into place. The bracing patch 5 may be made of pellon reinforcing materials or other similar materials as understood in the art.

The wearer or an assistant can align the complementary strips 2 and 4 by grabbing the closure flaps 3 and pulling them around the torso. By placing the strip 4 on the interior portion of the closure flaps 3, the garment allows either the individual or a caretaker to easily secure the correlating segments of the garment without being forced to operate about the immobile appendage. In another embodiment, the closure flaps 3 may also be reinforced by placing a bracing patch 5 on each flap; this also makes the flap easier to grab when securing the strips 2 and 4.

FIGS. 8-13 show variations on one embodiment of the apparatus wherein an oval-shaped segment of cloth is sewn over at least one armhole in the garment, closing the sleeve for patients who have lost an appendage.

Figure 14:
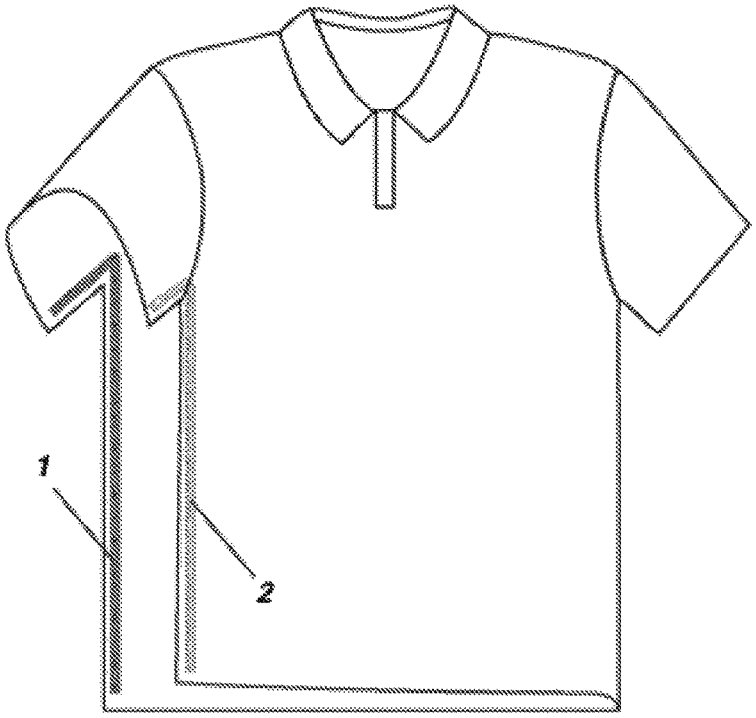
FIG. 14 shows a perspective view of another embodiment of the improved upper body-garment for a patient.

FIG. 14 shows another embodiment of the apparatus wherein the garment has a vertical opening along one side of the shirt. The complementary edges of the opening are lined with correlating Velcro strips 1 and 2 such that the segments of the garment may be placed in contact with one another, securing the garment along the entirety of the torso and down a segment of the individual's arm.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A post-surgical garment comprising:

a body portion having a neck opening located at a top of the body portion, a waist opening at a bottom of the body portion distal from the neck opening, a first side, and a second side;

a sleeve attached to the first side of the body portion;

an armhole opening formed on the second side of the body portion opposite the sleeve, wherein the body portion is split between a bottom of the armhole opening and the bottom of the body portion the armhole further including a circular portion attached over the armhole opening to substantially cover the armhole opening of the post-surgical garment;

a first closure mechanism located on opposing sides of the split formed on the body portion, the first closure mechanism for securing a front side of the split body portion to a back side of the split body portion to secure the post-surgical garment on a wearer.

2. The post-surgical garment of claim 1, the first closure mechanism comprising a hook and loop-type fastener.

3. The post-surgical garment of claim 2, the first closure mechanism further comprising a first hook strip extending from the back side of the split body portion and a corresponding loop portion attached on the front side of the split body portion for engaging the first hook strip when the post-surgical garment is worn.

4. The post-surgical garment of claim 3, further comprising a bracing patch located on the back side of the split body portion adjacent the first hook strip.

5. The post-surgical garment of claim 3, wherein in a closed position, the first closure mechanism secures a portion of the front side of the split body portion between the first hook strip and a portion of the back side split body portion.

6. The post-surgical garment of claim 1, wherein the post-surgical garment has the appearance of a polo-style shirt.

7. The post-surgical garment of claim 1, wherein the post-surgical garment has the appearance of a tank top shirt.

8. A post-surgical garment comprising:

a body portion having a neck opening located at a top of the body portion, a waist opening at a bottom of the body portion distal from the neck opening, a first side, and a second side;

a sleeve attached to the first side of the body portion;

an armhole opening formed on the second side of the body portion opposite the sleeve, wherein the body portion is split between a bottom of the armhole opening and the bottom of the body portion;

a first closure mechanism located on opposing sides of the split formed on the body portion, the first closure mechanism for securing a front side of the split body portion to a back side of the split body portion to secure the post-surgical garment on a wearer, the first closure mechanism including a first hook strip extending from the back side of the split body portion and a corresponding loop portion attached on the front side of the split body portion for engaging the first hook strip when the post-surgical garment is worn and a bracing patch located on the back side of the split body portion adjacent the first hook strip.

9. The post-surgical garment of claim 8, further comprising a bracing patch located on the back side of the split body portion adjacent the first hook strip.

10. The post-surgical garment of claim 8, wherein in a closed position, the first closure mechanism secures a portion of the front side of the split body portion between the first hook strip and a portion of the back side split body portion.

11. A post-surgical garment comprising:

a body portion having a neck opening located at a top of the body portion, a waist opening at a bottom of the body portion distal from the neck opening, a first side, and a second side;

a sleeve attached to the first side of the body portion;

an armhole opening formed on the second side of the body portion opposite the sleeve, wherein the body portion is split between a bottom of the armhole opening and the bottom of the body portion;

a first closure mechanism located on opposing sides of the split formed on the body portion, the first closure mechanism for securing a front side of the split body portion to a back side of the split body portion to secure the post-surgical garment on a wearer, the first closure mechanism including a first hook strip extending from the back side of the split body portion and a corresponding loop portion attached on the front side of the split body portion for engaging the first hook strip when the post-surgical garment is worn;

a bracing patch located on the back side of the split body portion adjacent the first hook strip;

wherein in a closed position, the first closure mechanism secures a portion of the front side of the split body portion between the first hook strip and a portion of the back side split body portion.

* * * * *